US012768347B2

(12) United States Patent
Deyo et al.

(10) Patent No.: US 12,768,347 B2
(45) Date of Patent: Oct. 20, 2026

(54) TORQUE CONVERTER CLUTCH APPLY SWITCH VALVE WITH INTERNAL LIMIT VALVE

(71) Applicant: Sonnax Transmission Company, Bellows Falls, VT (US)

(72) Inventors: Andrew Deyo, Langdon, NH (US); Todd V. Mangiagli, Westminster, VT (US); James A. Dial, Bellows Falls, VT (US)

(73) Assignee: Sonnax Transmission Company, Bellows Falls, VT (US)

( * ) Notice: Subject to any disclaimer, the term of this patent is extended or adjusted under 35 U.S.C. 154(b) by 298 days.

(21) Appl. No.: 18/589,036

(22) Filed: Feb. 27, 2024

(65) Prior Publication Data

US 2024/0295217 A1 Sep. 5, 2024

Related U.S. Application Data

(60) Provisional application No. 63/488,387, filed on Mar. 3, 2023.

(51) Int. Cl.

| | |
|---|---|
| ***F04B 53/14*** | (2006.01) |
| ***F04B 19/22*** | (2006.01) |
| ***F04B 53/12*** | (2006.01) |

(52) U.S. Cl.

CPC ..... *F04B 53/14* (2013.01); *F04B 19/22* (2013.01); *F04B 53/125* (2013.01)

(58) Field of Classification Search

CPC ..... F04B 53/14; F04B 53/125; F04B 19/22; F16D 48/02

See application file for complete search history.

(56) References Cited

U.S. PATENT DOCUMENTS

| | | | |
|---|---|---|---|
| 3,817,357 | A | 6/1974 | Mori |
| 3,864,915 | A | 2/1975 | Metailler |

(Continued)

FOREIGN PATENT DOCUMENTS

| | | | |
|---|---|---|---|
| GB | 1269896 | A | 4/1972 |
| GB | 1310625 | A | 3/1973 |
| JP | 5196127 | B2 | 5/2013 |

OTHER PUBLICATIONS

"Hydraulic Schematics" accessed from https://w05.dealerconnect.chrysler.com/service/mds2002/common/jsp/XML.jsp?XMLURL=/service/mds2002/serviceInfo/en_US/../en on Feb. 17, 2009.

(Continued)

*Primary Examiner* — Eric Keasel

(74) *Attorney, Agent, or Firm* — Andrus Intellectual Property Law, LLP

(57) ABSTRACT

A switch valve for a torque converter clutch switch valve body having a bore with line-in and apply ports. The switch valve has a plunger with a bore defined therein. The plunger is configured for moving in the switch valve body bore between first and second positions, whereby fluid communication with the line-in port is prevented and permitted in the first and second positions, respectively. A first spring biases the plunger towards the first position. A limit valve is positioned in the bore of the plunger and has a piston configured for moving in the plunger bore between first and second positions, whereby fluid communication with the apply port is prevented and permitted in the first and second positions, respectively. A second spring biases the limit valve towards the second position. Overpressure from the line-in port moves the piston towards the first position to prevent overpressure to the apply port.

20 Claims, 5 Drawing Sheets

(56) References Cited

U.S. PATENT DOCUMENTS

| | | | | | |
|---|---|---|---|---|---|
| 3,882,738 | A | * | 5/1975 | Audiffred, Jr. | B62D 11/08 192/221 |
| 3,960,172 | A | * | 6/1976 | Blake | F16D 48/02 137/504 |
| 4,294,278 | A | * | 10/1981 | Blake | F16D 48/0206 137/118.01 |
| 4,473,095 | A | * | 9/1984 | Motzer | F15B 20/001 137/596.18 |
| 4,478,237 | A | * | 10/1984 | Blake | F16D 25/14 192/48.601 |
| 4,890,636 | A | * | 1/1990 | Higuchi | F16D 48/04 192/85.48 |
| 5,743,823 | A | | 4/1998 | Younger | |
| 5,768,953 | A | | 6/1998 | Younger | |
| 6,117,047 | A | | 9/2000 | Younger | |
| 6,340,160 | B1 | | 1/2002 | Younger | |
| 6,485,277 | B2 | | 11/2002 | Agner | |
| 6,871,397 | B2 | | 3/2005 | Younger | |
| 6,964,628 | B2 | | 11/2005 | Younger | |
| 7,128,679 | B2 | | 10/2006 | Younger | |
| 9,429,228 | B2 | | 8/2016 | Younger | |
| 9,970,534 | B2 | | 5/2018 | Younger | |
| 10,724,628 | B2 | | 7/2020 | Hardin | |
| 10,948,059 | B2 | | 3/2021 | Hardin | |
| 11,105,415 | B2 | | 8/2021 | Hardin | |
| 11,408,447 | B2 | | 8/2022 | Hardin | |

OTHER PUBLICATIONS

"RCC Accumulator Piston and Sleeve Kit" accessed from https://transgo.com/product-details/rfe-tcc-accum/ on Sep. 21, 2022. "RFE-TCC-ACCUM" published 2020 by TransGo.

* cited by examiner

TORQUE CONVERTER CLUTCH APPLY SWITCH VALVE WITH INTERNAL LIMIT VALVE

CROSS REFERENCE TO RELATED APPLICATION

This application claims the benefit of U.S. Provisional Patent Application No. 63/488,387, filed Mar. 3, 2023, which is incorporated herein by reference in its entirety.

FIELD

The present disclosure generally relates to torque converter clutch apply switch valves.

BACKGROUND

The following description relates torque converter clutch (TCC) apply pressure switch valves and more particularly to TCC apply pressure limit switch valves.

In certain examples, such as for a Chrysler® 68RFE transmission, torque converter clutch (TCC) apply fluid is fed by the transmission hydraulic system fluid. The fluid at pressure passes through two valves on its way to the TCC: the TCC regulator valve and the TCC switch valve (see FIGS. 1 and 2). When solenoid pressure is applied to these two valves, they open a passageway leading to the apply side of the converter. In other examples, such as for Chrysler® 48RE transmission, a TCC apply fluid at pressure passes through a clutch converter (CC) valve and then a TCC switch valve the way to the TCC.

When the converter is in full apply mode, the passageway is open and the converter apply pressure is equal to the full line pressure, that is, the converter clutch apply fluid pressure can be equal to the system line pressure.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect according to the present disclosure generally relates to a torque converter clutch (TCC) switch valve configured for installation in a TCC switch valve body. The TCC switch valve body comprising a longitudinal bore and defining a line-in port, an apply port, and an exhaust port in fluid communication with the longitudinal bore. The switch valve has a plunger that extends from a first end to a second end with a bore defined in the second end, and the plunger being configured for reciprocating movement in the bore of the TCC switch valve body between a first position and an opposite second position. Fluid communication with the line-in port of the TCC switch valve body is prevented when the plunger is in the first position and permitted when the plunger is in the second position. A first spring biases the plunger towards the first position in the bore of the TCC switch valve body. A limit valve is positioned in the bore of the plunger. The limit valve has a piston configured for reciprocating movement in the bore in the plunger between a first position and a second position, where fluid communication with the apply port of the TCC switch valve body is prevented when the limit valve is in the first position and permitted when the limit valve is in the second position. A second spring biases the limit valve towards the second position in the bore of the plunger, where the limit valve is configured such that an overpressure from the line-in port overcomes the second spring to move the piston towards the first position to thereby prevent an overpressure to the apply port.

In certain examples, the first spring biases the plunger in a first direction, and the second spring biases the limit valve in a second direction that is different than the first direction. In certain examples, the first direction and the second direction are parallel but opposite to each other.

In certain examples, the limit valve is configured such that when the limit valve is in the first position the overpressure from the line-in port is directed other than to the exhaust port of the TCC switch valve body so as to conserve energy.

Another aspect according to the present disclosure generally relates to a method for using the TCC switch valve of the first aspect described above to protect a torque converter clutch from overpressure from the line-in port of the TCC switch valve body. The method includes removing a first switch valve from the bore of the TCC switch valve body, the first switch valve being configured for reciprocating movement in the bore to selectively permit fluid communication with the line-in port, and positioning the TCC switch valve of claim 1 in the bore of the TCC switch valve body.

Another aspect according to the present disclosure generally relates to a torque converter clutch (TCC) switch valve configured for installation in a TCC switch valve body, the TCC switch valve body having a longitudinal bore. The switch valve includes a plunger extending from a first end to a second end with a head at the first end and an internal cavity being defined by a partial bore in the second end, the plunger having first and second plunger ports in fluid communication with the internal cavity, and the plunger being configured for reciprocating movement in the switch valve body bore. A limit valve is positioned in the internal cavity of the plunger. The limit valve includes a piston configured for reciprocating movement in the partial bore in the plunger, the piston having at least two lands defining a recess therebetween and having a biasing member receiving region, the piston having a port in fluid communication with the recess and a bore formed partially therein in communication with the port, the bore having an open end opposite the biasing member receiving region. A biasing member is positioned between the piston at the biasing member receiving region and the plunger. A plug positioned in the second end of the plunger.

In certain examples, the plug is a snout. In certain examples, the biasing member positioned between the piston at the biasing member receiving region and the plunger is a second biasing member and further including a first biasing member positioned on the snout. In certain examples, the first and second biasing members are springs.

In certain examples, the TCC switch valve body comprises a line-in port, an apply port, and an exhaust port each in fluid communication with the longitudinal bore, and the plunger selectively fluidly couples at least the line-in port and the apply port.

In certain examples, the plunger biasing member receiving region is a cup-shaped region.

In certain examples, an end of the piston opposite the biasing member receiving region defines an impingement surface.

In certain examples, the plunger includes a stop wall in the internal cavity, and wherein an end of the piston cup shaped region engages the stop wall when the second spring is compressed.

In certain examples, the switch valve further including first and second lands, and wherein a first recess is positioned between the head the first land, and wherein a second recess is positioned between the first land and a second land. In certain examples, the second land extends to the second end of the plunger.

In certain examples, the snout is positioned in the plunger second end. In certain examples, the snout is configured to reciprocate with the plunger. In certain examples, an end of the snout and an end of the piston defines a pressure balance cavity.

Another aspect of the present disclosure generally relates to a kit for replacing an OEM TCC switch valve configured for installation in the OEM TCC switch valve body, the OEM TCC switch valve body having a longitudinal bore and defining a line-in port, an apply port, and an exhaust port in fluid communication with the longitudinal bore. The kit includes a plunger having a head at a first end and a second end, an internal cavity defined by a partial bore in the second end, and having first and second plunger ports in fluid communication with the internal cavity, the plunger being configured for reciprocating movement in the switch valve body bore. A limit valve is configured for positioning in the plunger internal cavity. The limit valve includes a piston configured for reciprocating movement in the plunger partial bore, the piston having at least two lands defining a recess therebetween and having a biasing member receiving region, the piston having a port in fluid communication with the recess and a bore formed partially therein in communication with the port, the bore having an open end opposite the biasing member receiving region. A biasing member is positioned between the piston at the biasing member receiving region and the plunger. A plug positioned in the second end of the plunger.

In certain examples, the plug is a snout.

It should be recognized that the different aspects described throughout this disclosure may be combined in different manners, including those than expressly disclosed in the provided examples, while still constituting an invention accord to the present disclosure.

Various other features, objects and advantages of the disclosure will be made apparent from the following description taken together with the drawings.

DETAILED DESCRIPTION

Figure 1:
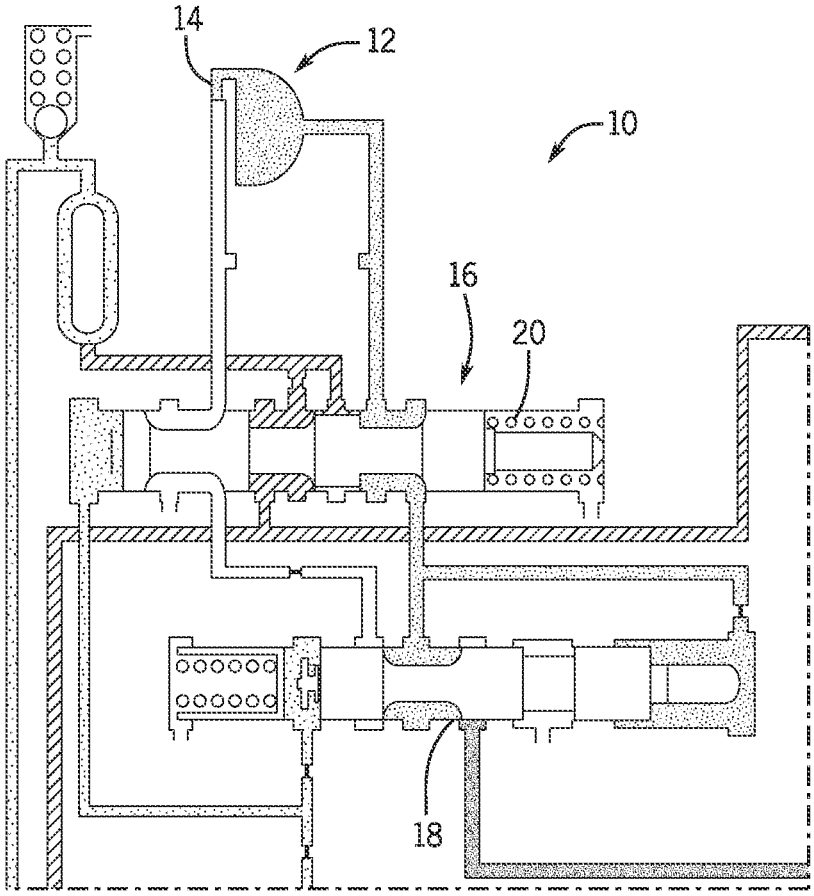
FIG. 1 is a schematic diagram illustrating a portion of one example of a known automatic transmission hydraulic fluid flow path showing the torque converter (TC) torque converter clutch (TCC), torque converter clutch switch valve (switch valve) and TCC regulator valve in the pressure or fluid apply mode to the TCC.
Figure 2:
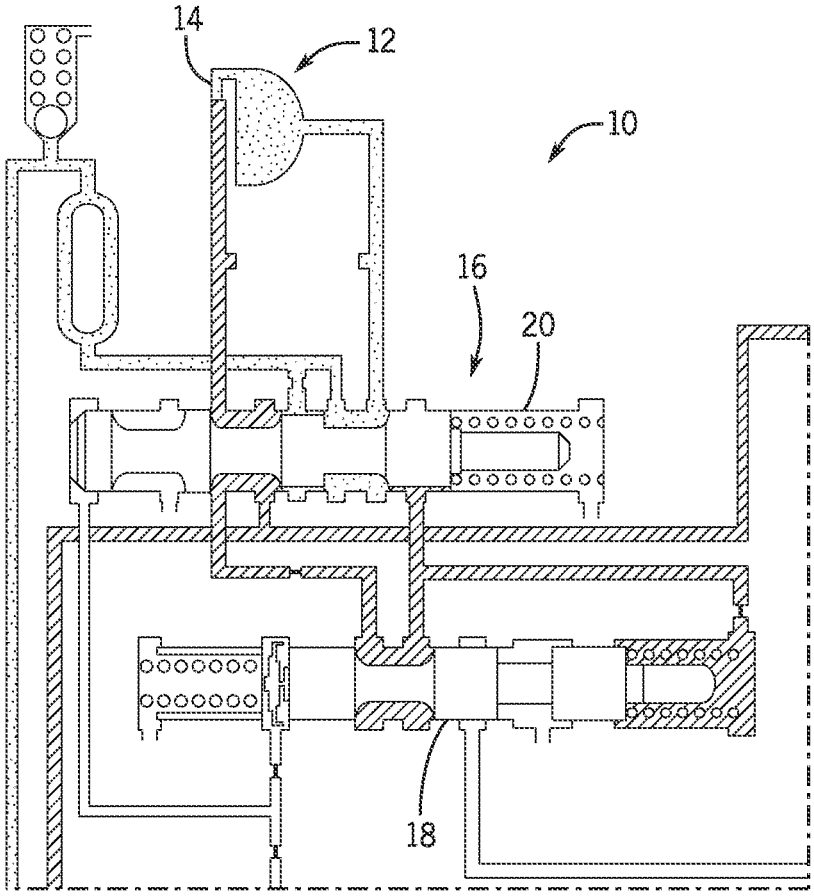
FIG. 2 is a schematic diagram of the portion of the automatic transmission hydraulic fluid flow path from FIG. 1, showing the TCC switch and regulator valves in the TCC released mode.

Referring to FIGS. 1 and 2, there is shown an example of a known hydraulic fluid circuit 10 for a vehicle transmission (e.g., a Chrysler® 68RFE transmission) having a torque converter (TC) 12 having a torque converter clutch (TCC) 14. Other vehicle transmission hydraulic circuits may be differently configured. The circuit 10 includes a switch valve 16 between a regulator valve 18 and the TCC 14. In FIG. 1, the TCC switch 16 valve is shown in the apply mode with fluid at pressure routed to the TCC 14. FIG. 2 shows the TCC switch valve 16 in the TCC released mode with fluid routed to the TCC 14 and returned from TCC 14 to the TCC switch valve 16.

As installed, fluid to the TCC 14 is routed through the TCC switch valve 16 (hereinafter "switch valve") and returns from the TCC 14 through the switch valve 16. The switch valve 16 is configured to route fluid at line pressure to the TCC 14 during certain operating conditions, and to route release pressure from the TCC 14 during other operating conditions.

The present disclosure also provides for devices and methods relating to known hydraulic fluid circuits for other types of vehicle transmissions, such as for a Chrysler® 68RFE transmission. In this case, torque converter clutch (TCC) apply fluid is fed by the transmission hydraulic system fluid. The fluid at pressure passes through two valves on its way to the TCC: the TCC regulator valve and the TCC switch valve (see FIGS. 1 and 2). When solenoid pressure is applied to these two valves, they open a passageway leading to the apply side of the converter. In other examples, such as for Chrysler® 48RE transmission, a TCC apply fluid at pressure passes through a clutch converter (CC) valve and then a TCC switch valve the way to the TCC.

When transmissions are upgraded to enhance performance, line pressures can exceed 250 psi. However, the present inventors have recognized that there is currently no pressure limiting mechanism on the apply side to protect the torque converter clutch. Such high fluid pressures can damage and even cause failure in an original equipment manufacturer (OEM) torque converter, including the TCC. Accordingly, the present inventors have recognized that there is a need for a TCC apply limit switch valve. Desirably, such a valve limits the maximum line pressure flowing to the TCC. In certain examples, such a valve advantageously mimics the OEM TCC switch valve function at normal pressures so as to not create partial apply drivability issues.

In certain examples, such a valve is advantageously of a drop-in design and can be installed easily within the OEM switch valve body. In certain examples, such a valve is advantageously of a drop-in design and can be installed within the OEM switch valve body and within needing to modify a switch valve body (e.g., without needing to resize via reaming a valve body bore). As described further below, certain embodiments of the disclosed herein provide for switch valves 102, 202 with internal limit valve 104, 204 (e.g., FIGS. 3-9) that are configured to be of the drop-in type and can installed in the switch valve body 20 without modification to the valve body 20. Other embodiments of the switch valves 102, 202 with internal limit valve 104, 204 described below are configured to be installed in the switch valve body 20 having a resized (e.g., reamed) valve body bore 20. As such, the switch valves 102, 202 with internal limit valve 104, 204 described herein can be installed, as a kit, into an existing, i.e., OEM, switch valve body 20.

Figure 3:
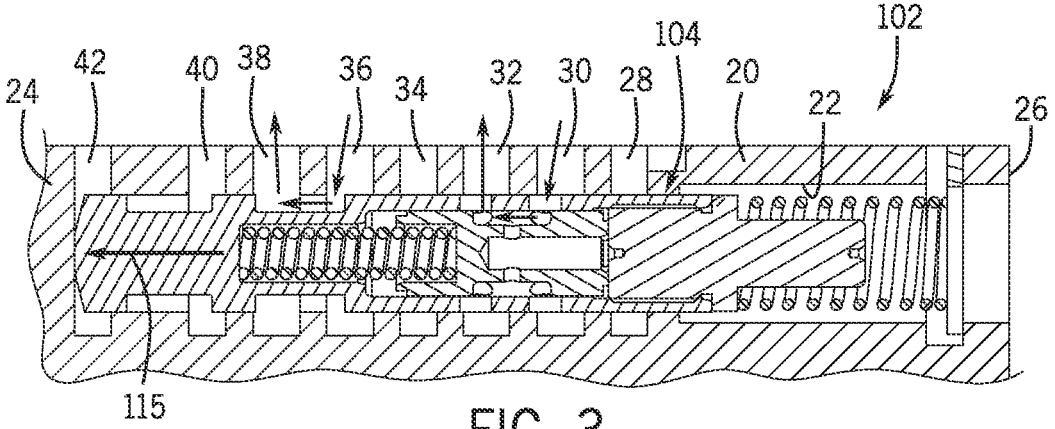
FIG. 3 is a sectional illustration of an embodiment of a TCC switch valve with an internal limit regulator valve (hereinafter "limit valve"), showing the TCC switch valve and limit valve in an as installed condition with no pressure applied in the fluid circuit, or the TCC released mode.
Figure 4:
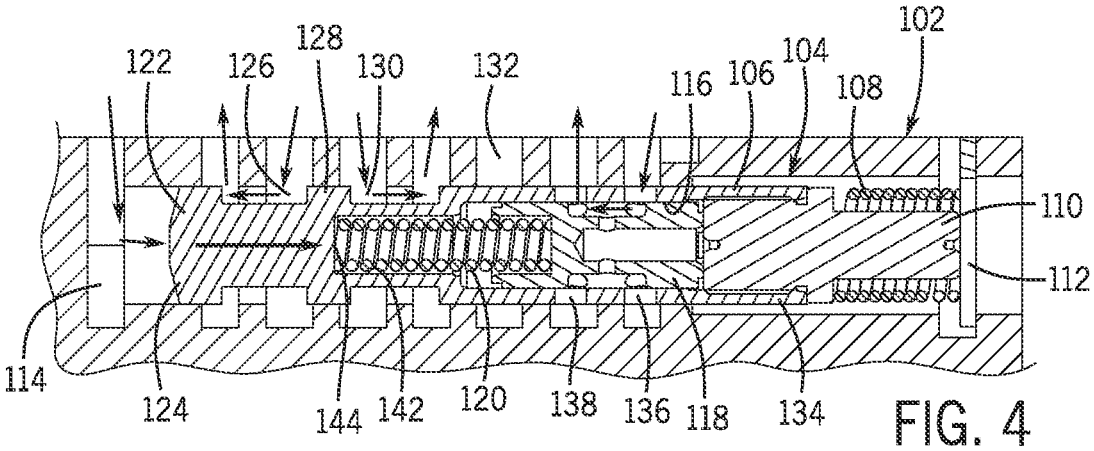
FIG. 4 is a sectional illustration similar to FIG. 3, showing the switch valve and limit valve in the TCC apply mode.
Figure 5:
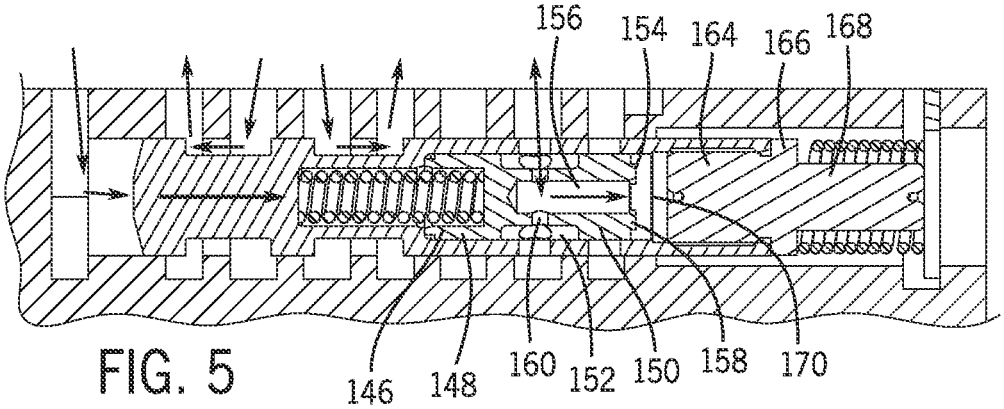
FIG. 5 is a sectional illustration similar to FIGS. 3 and 4, showing the limit valve in the hold or balance mode, limiting TCC apply pressure.

FIGS. 3-5 and 9 depict one example of a switch valve 102 with internal limit valve 104 configured to prevent over-pressure of a TCC 14, such as for a vehicle equipped with a Chrysler 68RFE transmission having a valve body 20. The switch valve 102 includes an internal limit valve 104, which is described in more detail below. The switch valve 102 further includes a plunger 106, a biasing element 108, such as a spring (also referred to as a first spring), and a plug or snout 110. The switch valve 102 is retained in place in the switch valve body 20 by a retainer 112, such as a spring clip. The plunger 106 reciprocates by action of a solenoid 114 to an actuated or on state (as shown in FIGS. 4 and 5) that is shown by the arrow at 115, and returns to an off state (as shown in FIG. 3) by a force exerted by the first spring 108.

The limit valve 104 is positioned in a cavity or bore 116 in the interior of the switch valve plunger 106. The limit valve 104 includes a piston 118 and a second biasing element 120, such as a spring (also referred to as a second spring).

The switch valve body 20 includes a through bore 22 extending from an inlet or upstream end 24 of the body 20 to an opposing end 26 of the body 20. The switch valve plunger 106, first spring 108 and snout 110 are positioned in the switch valve body through bore 22. The switch valve body 20 includes a number of ports, including a line-in port 28, an apply port 30 that routes fluid to and from the TCC 14, first and second cooler ports 32, 34, a regulator port 36, a return port 38, an exhaust port 40 and a control solenoid port 42. Other vehicle transmission hydraulic circuits may include these ports or may include greater or fewer ports.

With continued reference to FIGS. 3-5 and 9, the plunger 106 includes, at a closed end 122, a head or surface 124 acted upon by pressure sent from or routed via the solenoid port 114. A first or exhaust recess 126 is positioned between the head 124 and a plunger first land 128, a second or regulator recess 130 is positioned between the plunger first land 128 and a plunger second land 132. The plunger second land 132 extends along the plunger 106 to about an open end 134 of the plunger 106. The plunger 106 includes two ports 136, 138 (first and second plunger ports) formed through the body into a cavity 116 in the interior of the plunger 106 along the plunger second land 132.

The cavity 116 is formed by a bore in a portion of the plunger 106 extending inward from the second or open end 134 thereof. The cavity 116 is stepped having a smaller diameter 142 toward the closed end 122. The second spring 120 is positioned in the cavity 116 within the smaller diameter 142 and abutting an interior wall 144 of the cavity 116.

The limit valve 104, which is positioned in the plunger cavity 116, includes the limit valve piston 118 and the second spring 120. The limit valve 104 is positioned in the cavity 116 and has a cup-shaped receiving end 146 for receiving an end of the second spring 120 such that the piston 118 reciprocates within the plunger cavity 116. In this manner, the second spring 120 is captured between the cavity interior wall 144 and the piston receiving end 146.

The piston receiving end defines a piston first land 148. The piston 118 includes a piston second land 150 and defines a recess 152 (the line feed recess) along the body between the piston first and second lands 148, 150. An end of the piston 118 defines an impingement surface 154.

The piston 118 further includes a longitudinal bore 156 therein extending partially into the piston from an end 158 opposite the receiving end 146. A port 160 is formed in the piston 118 at the line feed recess 152 into the piston bore 156.

The snout 110 includes a sealing end 164 positioned in the plunger open end 134, a flange 166 that abuts the plunger open end 134 and a shaft or pintle 168 extending from the flange 166. During some operating conditions, a pressure balance cavity 170 is created between the impingement surface 154 and the snout sealing end 164 (see, for example, FIG. 5). The first spring 108 is positioned on the shaft 168. The plunger 106, first spring 108, limit valve piston 118 and second spring 120, and the snout 110 are secured in place in the valve body 20 by the retainer 112.

Operation of this embodiment of the switch valve 102 with the internal limit valve 104 will now be described with reference to FIGS. 3-5, which illustrate the valve 102 and fluid flow in three scenarios: (1) no or low solenoid pressure or as the switch valve 102 is installed in the switch valve body 20 as illustrated in FIG. 3; (2) solenoid pressure is applied and line (fluid) pressure to the TCC 14 is increased as illustrated in FIG. 4; and (3) solenoid pressure is applied and line (fluid) pressure to the TCC 14 is held at a desired pressure or balanced as illustrated in FIG. 5.

Referring to FIG. 3, scenario (1) shows the switch valve 102 as installed with no pressure from the solenoid port 114 applied. The solenoid is off and line (fluid) pressure is blocked (e.g., is low or zero). With no solenoid pressure, the first spring 108 (the plunger spring) shuttles the plunger 106 to the left and the second spring 120 (the limit valve spring) urges the piston 118 to the right. The piston impingement surface 154 rests on or abuts the plug/snout 110.

With no solenoid pressure and the plunger 106 shuttled to the left, the line-in port 28 is closed by the plunger second land 132, the apply port 30 is open to the plunger second port 138 which is in communication with the piston line feed recess 152 and the cooler first port 32. The cooler second port 34 is closed by the plunger second land 132. The regulator port 36 is open to the plunger regulator recess 130 which is open to the return port 38, and the exhaust port 40 is closed by virtue of the plunger first land 128.

As noted, the apply port 30 is open to the piston line feed recess 152. This provides fluid communication with the piston longitudinal bore 156 via the piston port 160.

Referring to FIG. 4, scenario (2) shows solenoid pressure applied and line (fluid) pressure flowing to the TCC 14 increasing. In this scenario, the pressure in the solenoid port 114 shuttles the plunger 106 to the right against the spring pressure of the first spring 108. As the plunger 106 is shuttled to the right, fluid at line pressure enters the valve body 20 at the line-in port 28, enters the plunger 106 via the first plunger port 136, enters the plunger 106 (to the piston longitudinal bore 156) via the line feed recess 152 and enters the piston port 160, increasing the pressure in the pressure balance cavity 170.

Fluid at line pressure entering via the line feed recess 152 is routed to the TCC 14 via the second plunger port 138 and piston line feed recess 152 through the apply port 30 in the valve body 20. Fluid that flows into the piston 118 via the line feed recess 152 flows into the piston port 160 and into the piston bore 156 and applies pressure against the snout sealing end 164 urging the piston 118 to the left as pressure in the pressure balance cavity 170 increases. Movement of the piston 118 to the left is against the spring force of the second spring 120.

At the same time, with the plunger 106 shuttled to the right, fluid from the regulator port 36 (fluid fed into the regulator port) is routed via the regulator recess 130 to the cooler via the second cooler port 34 and return fluid from the TCC 14 entering in through the return port 38 is routed to the exhaust port 40 via the exhaust recess 126. In this manner, line pressure to the TCC 14 is increased.

Referring to FIG. 5, scenario (3) shows solenoid pressure applied and line (fluid) pressure to the TCC 14 is held at a desired pressure or balanced. In this scenario, solenoid pressure is applied with the plunger 106 shuttled to the right against spring force of the first spring 108. As the plunger 106 is shuttled to the right, fluid at line pressure enters the valve body 20 at the line-in port 28 and the first plunger port 136, but is blocked by the piston second land 150. In this position, the apply port 30 is aligned with the second plunger port 138 and apply fluid enters the line feed recess 152, the piston port 160 and the piston longitudinal bore 156 to exert fluid pressure against the snout 110 and the piston impingement surface 154, filling the pressure balance cavity 170 and urges the piston 118 to the left (against the second spring 120 force).

In this scenario, the first cooler port 32 is blocked by the plunger second land 132, the regulator port 36 is in fluid communication with the second cooler port 34 via the regulator recess 130, and the return port 38 is in fluid communication with the exhaust port 40 via the exhaust recess 126.

It will be appreciated that with solenoid pressure applied, the limit valve 104 will cycle between scenarios (2) and (3) to control and balance the pressure to the TCC 14. In this manner, the switch valve 102 and limit valve 104 areas and the first and second spring 108, 120 rates can be set to permit increasing and maintaining the flow and pressure to the TCC 14 at desired rates and levels, while also preventing overpressurized flow to the TCC 14.

Figure 6:
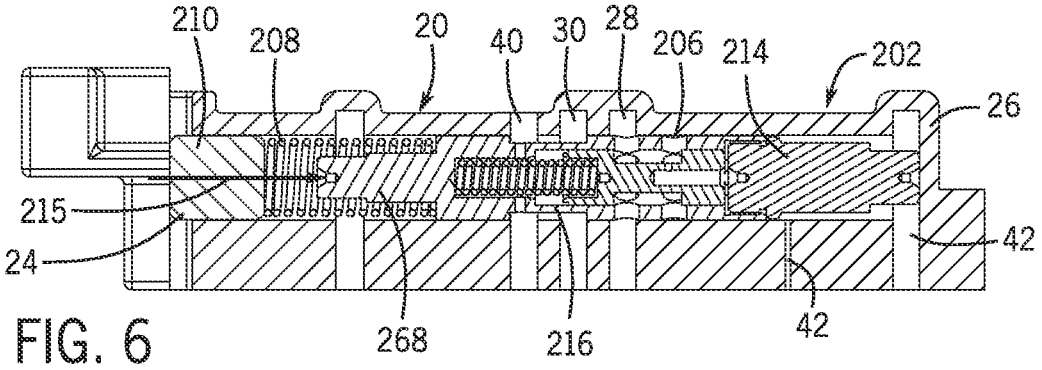
FIG. 6 is a sectional illustration of another embodiment of a TCC switch valve with an internal limit regulator valve, showing the TCC switch valve and limit valve in an as installed condition with no pressure applied in the fluid circuit, or the TCC released mode.
Figure 7:
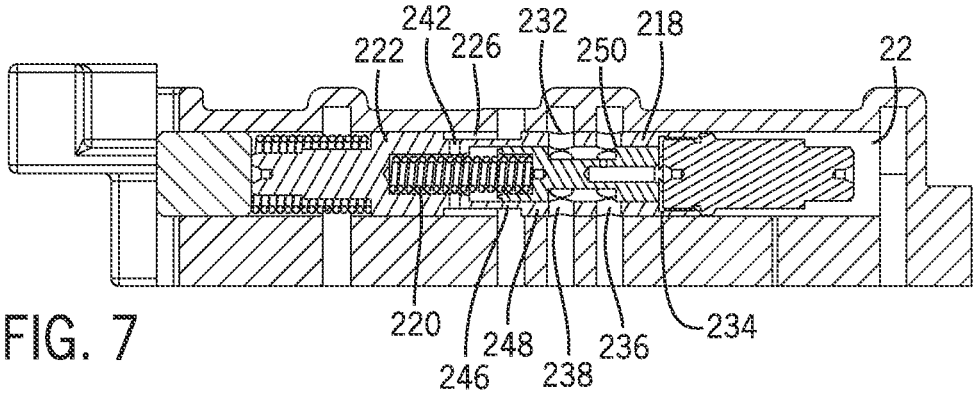
FIG. 7 is a sectional illustration similar to FIG. 6, showing the limit valve in the TCC apply mode.
Figure 8:
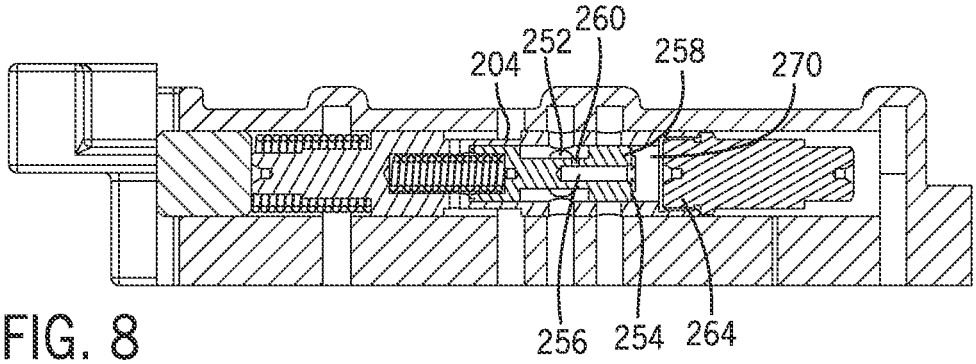
FIG. 8 is a sectional illustration similar to FIGS. 6 and 7, showing the limit valve in the hold or balance mode, limiting TCC apply pressure.
Figure 9:
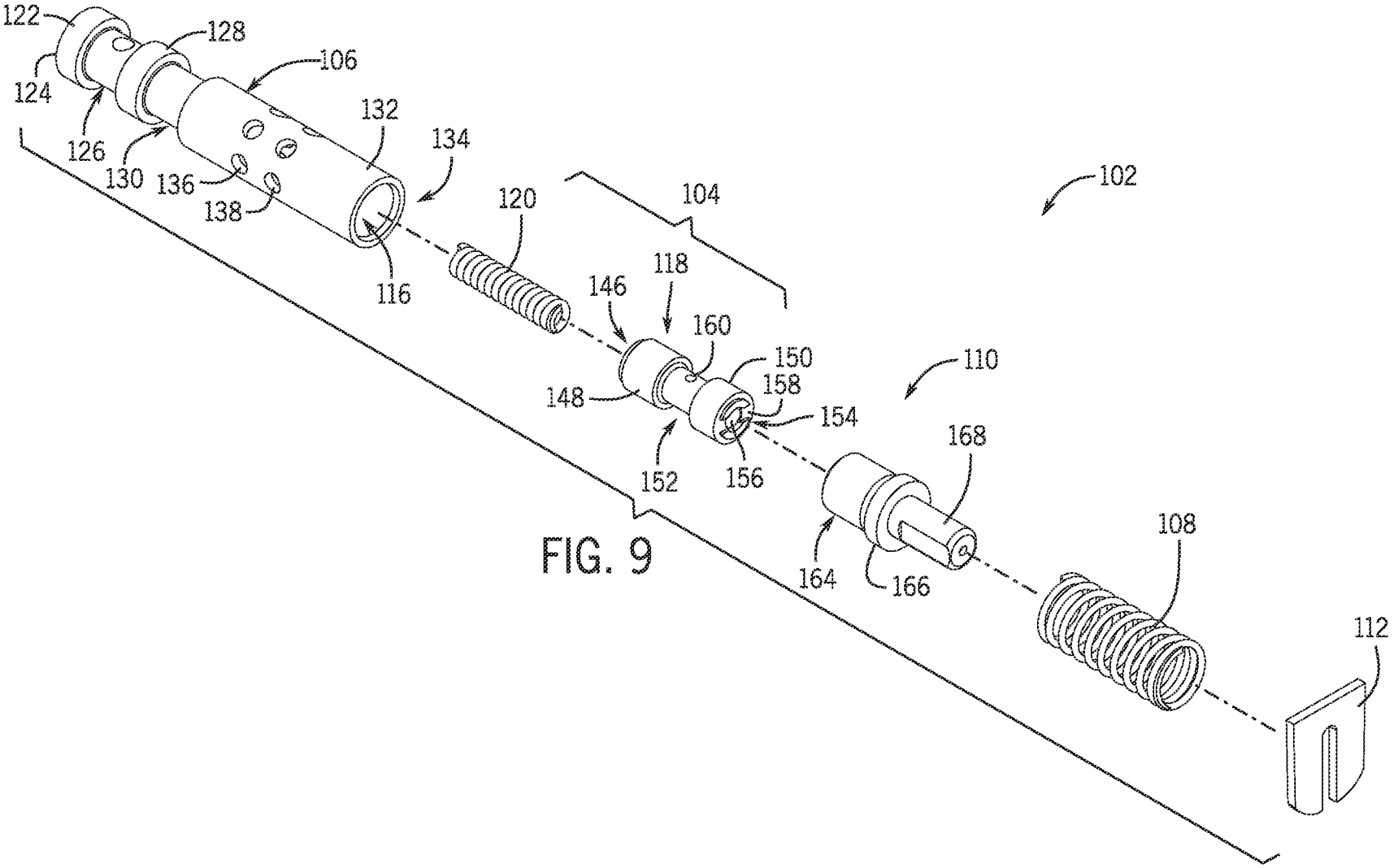
FIG. 9 is an exploded perspective view of the TCC switch valve of FIG. 3.

Referring to FIGS. 6-8, there is shown another embodiment of a switch valve 202 with internal limit valve 204, which for example may be configured for a vehicle equipped with Chrysler 46-48E (46/47RH/Res through 48) transmission. Those skilled in the art and familiar with this series of transmissions will recognize this valve, which functions as a switch valve, is referred to as a Converter Clutch or CC valve. This is distinguished from another valve in the hydraulic system that is referred to as the Converter Clutch Switch Valve or CCSV. As such, the following description refers to the aforementioned CC valve, but will be referred to herein as the "switch valve" for ease of understanding and for its function within the hydraulic system.

It is also to be understood that this valve body has fewer ports than that shown in FIGS. 3-5, and as such, not all of the ports will be referred to in the following description. The switch valve 202 includes a plunger 206, a first biasing element 208, such as a spring (the first spring), a plug 210, and a snout 214. The switch valve 202 is retained in place in the switch valve body 20 by the end plug 210. The plunger 206 reciprocates by action of the first spring 208 to an off state which is shown by the arrow at 215, and shuttles to an on state by a force exerted by solenoid pressure.

The limit valve 204 is positioned in a bore or cavity 216 in the interior of the switch valve plunger 206. The limit valve 204 includes a piston 218 and a second biasing element 220, such as a spring (the second spring).

As shown in FIG. 6, the switch valve body 20 includes a bore 22 extending from an inlet or upstream end 24 (also referred to as an "outboard end") of the body 20 to an opposing end 26 of the body 20 (also referred to as an "inboard end") of the body 20. The switch valve body 20 includes a number of ports, including a control solenoid pressure port 42, a line-in port 28, an apply port 30 that routes fluid to the TCC 14 and an exhaust port 40.

The plunger 206 includes a closed end 222 having a shaft 268 having a diameter reduced from that of the plunger 206. The first spring 208 is positioned on the shaft 268. An exhaust recess 226 is formed in the plunger 206 that extends longitudinally along a portion of the plunger 206. The plunger includes two ports (first and second plunger ports 236, 238) formed through the body into the cavity 216 in the interior of the plunger 206 adjacent to and spaced from the exhaust recess 226.

The cavity 216 is formed by a bore in a portion of the plunger 206 extending inward from a second or open end 234 thereof. The cavity 216 is stepped having a smaller diameter 242 toward the closed end 222.

The limit valve piston 218 is positioned in the plunger cavity 216 and has a cup-shaped receiving end 246 for receiving an end of the second spring 220 such that the piston 218 reciprocates within the plunger cavity 216. In this manner, the second spring 220 is captured between an interior wall of the plunger cavity 216 and the piston receiving end 246.

The cup shaped receiving end 246 defines a piston first land 248. The piston 218 includes a piston second land 250 and defines a recess 252 (the line feed recess) along the body between the plunger first and second lands 248, 250. An end of the piston defines an impingement surface 254, and a balance pressure cavity 270 is defined between the impingement surface 254 and the snout 214 in certain operating conditions (see, for example, FIG. 8).

The piston 218 further includes a longitudinal bore 256 therein extending partially into the piston 218 from an end (a second end 258) opposite the cup-shaped end 246. Ports 260 are formed in the piston 218 at the line feed recess 252 into the piston bore 256.

The snout 214 includes a sealing end 264 positioned in the plunger open end 234. The snout 214 serves as a plug in the plunger second or open end 234. The plunger 206, first spring 208, limit valve piston 218 and second spring 220, and the snout 214 are secured in place in the valve body 20 by the end plug 210.

Operation of this embodiment of the switch valve 202 with the internal limit valve 204 will now be described with reference to FIGS. 6-8, which illustrate the valve 202 and fluid flow in three scenarios: (1) solenoid is off or as the switch valve is installed in the switch valve body as illustrated in FIG. 6; (2) solenoid pressure is applied and line (fluid) pressure to the TCC is increased as illustrated in FIG. 7; and (3) solenoid pressure is applied and line (fluid) pressure to the TCC is held at a desired pressure or balanced as illustrated in FIG. 8.

Referring to FIG. 6, scenario (1) shows the switch valve 202 as installed with no pressure applied. The solenoid is off. With no solenoid pressure applied, the plunger 206 is shuttled to the right by spring force of the first spring 208. As the plunger 206 is shuttled to the right, fluid at line pressure enters the valve body 20 at the line-in port 28, then enters plunger port 236, but is blocked by the piston first land 248. The apply port 30 is in fluid communication with the exhaust port 40 via the plunger exhaust recess 226.

Referring to FIG. 7, scenario (2) shows solenoid pressure applied and line (fluid) pressure to the TCC 14 is increasing. In this scenario, solenoid pressure enters at port 42 and shuttles the snout 214 and the plunger 206 to the left against the spring force of the first spring 208. As the plunger 206 is shuttled to the left, fluid at line pressure enters the valve body 20 at the line-in port 28, enters the plunger 206 via the plunger first port 236, and enters the piston 218 via the line feed recess 252 and the piston port 260, filling and increasing the pressure in the pressure balance cavity 270.

Fluid is routed to the TCC 14 via the second plunger port 238 and line feed recess 252 through the apply port 30 in the valve body 20. Fluid that flows into the piston 218 via the line feed recess 252 flows into the piston bore 256 and increases the pressure against the snout 214 (in the pressure balance cavity 270) urging the piston 218 to the left. Movement of the piston 218 to the left is against the spring force of the second spring 220. With the plunger 206 shuttled to the left, the exhaust port 40 is closed off.

Referring now to FIG. 8, scenario (3) shows solenoid pressure applied and line (fluid) pressure to the TCC 14 is held at a desired pressure (or balanced), or decreasing. In this scenario, solenoid pressure is applied at port 42 with the plunger 206 shuttled to the left against the spring force of the first spring 208. As the plunger 206 is shuttled to the left, fluid at line pressure enters the valve body 20 at the line-in port 28 and the plunger 206 via the first plunger port 236, but is blocked by the piston second land 250 from entering the piston 218 (due to increased pressure in the pressure balance cavity 270) by the increased fluid pressure. The fluid pressure in the pressure balance cavity 270 urges the piston 218 to the left against the second (piston) spring 220 force. Fluid (apply pressure) to the TCC 14 is held at a constant pressure.

In this position, the apply port 30 is aligned with the second plunger port 238, and apply fluid enters the piston port 260 and the piston longitudinal bore 256 to exert fluid pressure against the snout 214 and the piston impingement surface 254, urging the piston 218 to the left (against the second spring 220 force), and the exhaust port 40 is blocked.

As with the previously described embodiment, in this embodiment of the switch valve 202, with solenoid pressure applied, the limit valve 204 will cycle between scenarios (2) and (3) to control and balance the pressure to the TCC 14. In this manner, the switch valve 202 and limit valve 204 areas and the first and second spring 208, 220 rates can be set to permit increasing and maintaining the flow and pressure to the TCC 14 at desired rates and levels, while also preventing over-pressurized flow to the TCC 14.

In present switch valves 102 and 202, the spring 108, 120, 208, 220 rates and the valve 102, 104, 202, 204 areas are established such that the apply pressure is limited to about 125 psi to about 140 psi. In such embodiments, when transmissions are upgraded to enhance performance, the line (apply) pressure is limited on the apply side, by the TCC switch valves 102, 202 with internal limit valves 104, 204, so as to protect and prevent damage to the TCC.

Another advantage of the present switch valves with internal limit valves 102, 202 is that such valves can be installed in OEM hydraulic valve bodies 20. That is, the present switch valves with internal limit valves 102, 202 can be configured as kits that include the plungers 106, 206, pistons 118, 218, piston (second) springs 120, 220, and snout or cap 110. It is contemplated that the OEM switch valve (first) spring 108, 208 may be used or may be replaced when using the present switch valves with internal limit valves 102, 202 as "kits".

It is understood that the features described with respect to any of the embodiments above may be implemented, used together with, or replace features described in any of the other embodiments above. It is also understood that description of some features may be omitted in some embodiments, where similar or identical features are discussed in other embodiments.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular. In addition, in is understood that terminology referring to directions or relative orientations, such as, but not limited to, "upper" "lower" "raised" "lowered" "top" "bottom" "above" "below" "alongside" "left" and "right" are used for purposes of example and do not limit the scope of the subject matter described herein to such orientations or relative positioning.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

The invention claimed is:

1. A torque converter clutch (TCC) switch valve configured for installation in a TCC switch valve body, the TCC switch valve body comprising a longitudinal bore and defining a line-in port, an apply port, and an exhaust port in fluid communication with the longitudinal bore, the switch valve comprising:

a plunger that extends from a first end to a second end with a bore defined in the second end, and the plunger being configured for reciprocating movement in the bore of the TCC switch valve body between a first position and an opposite second position, wherein fluid communication with the line-in port of the TCC switch valve body is prevented when the plunger is in the first position and permitted when the plunger is in the second position;

a first spring that biases the plunger towards the first position in the bore of the TCC switch valve body; and a limit valve positioned in the bore of the plunger, the limit valve comprising:

a piston configured for reciprocating movement in the bore in the plunger between a first position and a second position, wherein fluid communication with the apply port of the TCC switch valve body is prevented when the limit valve is in the first position and permitted when the limit valve is in the second position; and a second spring that biases the limit valve towards the second position in the bore of the plunger, wherein the limit valve is configured such that an overpressure from the line-in port overcomes the second spring to move the piston towards the first position to thereby prevent an overpressure to the apply port.

2. The switch valve according to claim 1, wherein the first spring biases the plunger in a first direction, and wherein the second spring biases the limit valve in a second direction that is different than the first direction.

3. The switch valve according to claim 2, wherein the first direction and the second direction are parallel but opposite to each other.

4. The switch valve according to claim 1, wherein the limit valve is configured such that when the limit valve is in the first position the overpressure from the line-in port is directed other than to the exhaust port of the TCC switch valve body so as to conserve energy.

5. A torque converter clutch (TCC) switch valve configured for installation in a TCC switch valve body, the TCC switch valve body having a longitudinal bore, the switch valve comprising:

a plunger extending from a first end to a second end with a head at the first end and an internal cavity being defined by a partial bore in the second end, the plunger having first and second plunger ports in fluid communication with the internal cavity, and the plunger being configured for reciprocating movement in the switch valve body bore;

a limit valve positioned in the internal cavity of the plunger, the limit valve comprising:

a piston configured for reciprocating movement in the partial bore in the plunger, the piston having at least two lands defining a recess therebetween and having a biasing member receiving region, the piston having a port in fluid communication with the recess and a bore formed partially therein in communication with the port, the bore having an open end opposite the biasing member receiving region; and a biasing member positioned between the piston at the biasing member receiving region and the plunger; and a plug positioned in the second end of the plunger.

6. The switch valve of claim 5, wherein the plug is a snout.

7. The switch valve of claim 6, wherein the biasing member positioned between the piston at the biasing member receiving region and the plunger is a second biasing member and further including a first biasing member positioned on the snout.

8. The switch valve of claim 7, wherein the first and second biasing members are springs.

9. The switch valve of claim 6, wherein the snout is positioned in the plunger second end.

10. The switch valve of claim 9, wherein the snout is configured to reciprocate with the plunger.

11. The switch valve of claim 10, wherein an end of the snout and an end of the piston defines a pressure balance cavity.

12. The switch valve of claim 5, wherein the TCC switch valve body comprises a line-in port, an apply port, and an exhaust port each in fluid communication with the longitudinal bore, and wherein the plunger selectively fluidly couples at least the line-in port and the apply port.

13. The switch valve of claim 5, wherein the biasing member receiving region is a cup-shaped region.

14. The switch valve of claim 5, wherein an end of the piston opposite the biasing member receiving region defines an impingement surface.

15. The switch valve of claim 5, wherein the plunger includes a stop wall in the internal cavity, and wherein an end of the piston engages the stop wall when the biasing member is compressed.

16. The switch valve of claim 5, further including first and second lands, and wherein a first recess extends radially inwardly and is positioned between the head and the first land axially, and wherein a second recess extends radially inwardly and is positioned between the first land and a second land axially.

17. The switch valve of claim 16, wherein the second land extends to the second end of the plunger.

18. A kit for replacing an OEM TCC switch valve configured for installation in the OEM TCC switch valve body, the OEM TCC switch valve body having a longitudinal bore and defining a line-in port, an apply port, and an exhaust port in fluid communication with the longitudinal bore, kit comprising:

a plunger having a head at a first end and a second end, an internal cavity defined by a partial bore in the second end, and having first and second plunger ports in fluid communication with the internal cavity, the plunger configured for reciprocating movement in the switch valve body bore;

a limit valve configured for positioning in the plunger internal cavity, the limit valve comprising:

a piston configured for reciprocating movement in the plunger partial bore, the piston having at least two lands defining a recess therebetween and having a biasing member receiving region, the piston having a port in fluid communication with the recess and a bore formed partially therein in communication with the port, the bore having an open end opposite the biasing member receiving region; and a biasing member positioned between the piston at the biasing member receiving region and the plunger; and a plug positioned in the second end of the plunger.

19. The kit of claim 18, wherein the plug is a snout.

20. A method for protecting a torque converter clutch (TCC) from overpressure from a line-in port of a TCC switch valve body, the method comprising removing a first switch valve from a bore of the TCC switch valve body, the first switch valve being configured for reciprocating movement in the bore to selectively permit fluid communication with the line-in port, and positioning the switch valve of claim 1 in the bore of the TCC switch valve body.

* * * * *